United States Patent [19]

Naik

[11] 4,451,431

[45] May 29, 1984

[54] MOLYBDENUM-CONTAINING HIGH TEMPERATURE COATINGS FOR NICKEL- AND COBALT-BASED SUPERALLOYS

[75] Inventor: Subhash K. Naik, Milford, Conn.

[73] Assignee: Avco Corporation, Stratford, Conn.

[21] Appl. No.: 436,469

[22] Filed: Oct. 25, 1982

[51] Int. Cl.[3] ..... B32B 15/04

[52] U.S. Cl. ..... 420/588; 420/443; 420/444; 420/580; 428/678

[58] Field of Search ..... 420/443, 444, 580, 588; 428/678

[56] References Cited

U.S. PATENT DOCUMENTS

| | | | |
|---|---|---|---|
| 4,061,495 | 12/1977 | Selman et al. | 420/444 |
| 4,314,007 | 2/1982 | Gessinger | 428/678 |
| 4,339,509 | 7/1982 | Dardi et al. | 428/668 |
| 4,346,137 | 8/1982 | Hecht | 420/443 |
| 4,369,233 | 1/1983 | van Schaik | 428/678 |

*Primary Examiner*—Veronica O'Keefe

*Attorney, Agent, or Firm*—Ralph D. Gelling

[57] ABSTRACT

Disclosed are novel high temperature coatings which may be applied to turbine engine components to provide improved thermal fatigue resistance as well as improved oxidation and corrosion resistance. The compositions have one of the following general formulas:

MCrAl+Rare Earth Metal (1)

MCrAl+Rare Earth Metal+Noble Metal (2)

MCrAl+Rare Earth Metal+Refractory Metal; or (3)

MCrAl+Rare Earth Metal+Noble Metal+Refractory Metal (4)

wherein M is a solid solution of molybdenum, tungstun or niobium in nickel, cobalt or nickel plus cobalt.

26 Claims, No Drawings

MOLYBDENUM-CONTAINING HIGH TEMPERATURE COATINGS FOR NICKEL- AND COBALT-BASED SUPERALLOYS

BACKGROUND OF THE INVENTION

I. Field of the Invention

This invention relates, in general, to coatings and, in particular, to metal coatings for nickel and cobalt base superalloys, dispersion strengthened alloys, directionally-solidified/single crystal alloys and composites thereof. More specifically, the present invention relates to novel molybdenum-containing metal coatings having high ductility and thermal fatigue resistance while retaining stability and oxidation and corrosion resistance. The novel compositions of the present invention have one of the following general formulas: (1) MCrAl+-Rare Earth Metal; (2) MCrAl+Rare Earth Metal+Noble Metal; (3) MCrAl+Rare Earth Metal+Refractory Metal; or (4) MCrAl+Rare Earth Metal+Noble Metal+Refractory Metal, where M is a solid solution of molybdenum, tungsten or niobium in nickel, cobalt or nickel plus cobalt.

II. Description of the Prior Art

Scott et al, U.S. Pat. No. 2,403,128, discloses alloys which include molybdenum in solid solution, which is then partially precipitated, and are used to achieve high-temperature and corrosion resistance. The higher strength in this, case, is achieved by precipitation hardening treatment. It is directed to alloys containing primarily chromium, nickel, molybdenum and manganese which are precipitation-hardened by quenching them from a high temperature and then aging them at a somewhat lower temperature (i.e. 1,000° C.-1,300° C. and 700° C.-1,000° C., respectively).

Freeman, U.S. Pat. No. 3,592,638, discloses a cobalt-base metal alloy with improved high temperature properties which consists essentially of 0.7%-0.9% carbon, 20%-26% chromium, 9%-12% nickel, 6%-8% tungsten, 2%-8% tantalum and the balance cobalt (all percentages by weight).

Dalai et al, U.S. Pat. No. 3,807,993 discloses nickel base, cobalt containing, alloys including tungsten, molybdenum, chromium, tantalum, aluminum, titanium and hafnium.

Herchenroeder et al, U.S. Pat. No. 4,012,229 discloses a cobalt-base alloy with improved ductility at temperatures of about 2,000° F. which consists essentially of 15%-30% chromium, 10%-30% nickel, 1%-8% molybdenum, up to 10% tungsten, and 8%-20% tantalum. The molydbenum is used to impart ductility.

Goward et al, U.S. Pat. No. 3,754,903 discloses a coating alloy for gas turbine engine superalloys of the NiCrAlY type; Evans et al, U.S. Pat. No. 3,676,085 discloses a coating of the CoCrAlY type; and Talboom et al, U.S. Pat. No. 3,545,530 disclosed one of the FeCrAlY type.

Felten, U.S. Pat. No. 3,918,139 discloses nickel, cobalt and nickel-cobalt coating compositions consisting essentially of 8%-30% chromium, 5%-15% aluminum, up to 1% of a rare earth metal such as yttrium, scandium or thorium, 3%-12% of a noble metal selected from platinum or rhodium and the balance nickel, cobalt or nickel-cobalt (all percentages are by weight). Hecht et al, U.S. Pat. No. 3,928,026, discloses a ductile coating for nickel and cobalt-base superalloys consisting essentially of 11%-48% cobalt, 10%-40% chromium, 9%-15% aluminum, 0.1%-1.0 % of a rare earth metal, and the balance nickel, the nickel content being at least 15% (all percentages are by weight).

Wlodek, U.S. Pat. No. 4,022,587 discloses nickel and cobalt base alloy articles coated with a composition consisting essentially of 20%-60% chromium, 6%-11% aluminum, 0.01%-2.0% reactive metal such as yttrium, lanthanum or cerium and the balance metal (all percentages are by weight).

Gupta et al, U.S. Pat. No. 4,198,442 discloses a method of producing metal articles resistant to corrosion at high temperatures which involves the application of a first coating, comprising a cobalt, iron or nickel alloy which is ductile and compatible with the substrate, on an article surface. A second coating, resistant to corrosion at high temperatures, is applied over the first coating to form a composite coating and an elevated temperature treatment follows to provide interfacial bonding and to minimize the detrimental effects of stresses encountered during use.

The scope of the present invention, as defined in the appended claims, patentably distinguishes over the foregoing art, taken either individually or in combination with another.

The current high cost of quality fuels for gas turbines has made it economically attractive to use lower quality fuels or to increase the temperature of the turbine. These lower quality fuels may contain harmful alkali-sulfates which cause accelerated hot corrosion attack of the hot gas path components of gas turbines. The hot gas path components, such as vanes and blades, are generally constructed of nickel base or cobalt base superalloys. The superalloys, while possessing high strength at high temperatures, are quite prone to the accelerated corrosive effects of the hot gas path.

Attempts have been made to replace the superalloy components with corrosion-resistant materials, but these have been unsuccessful because the cast, powder, metallurgical and wrought alloys having the necessary corrosion resistance do not possess sufficient mechanical properties for service in the gas turbine environment. One approach has been to clean the front end fuel or inlet air of corrosive elements. This approach, however, is very expensive and lacks versatility to handle diverse fuels.

Another approach has been to coat the superalloy component with certain corrosion resistant materials. This approach, however, has not proven completely successful since coatings are prone to failure by a variety of mechanisms. Aluminide coatings, for example, can be a source of fracture initiation in fatigue. Coating ductility has been found to be an important determinant in fatigue life since, at relatively low temperatures, aluminide coatings tend to crack in a brittle manner at low strains in the tensile portions of the fatigue cycle. Still some other present day coatings are brittle and have a tendency of spalling or forming cracks.

Although various coatings, such as those described in U.S. Pat. No. 3,676,085; 3,754,903; 3,542,530 and 3,928,026, mentioned above, among other, have in the past provided significant improvements in the lifetimes of superalloys, further improvements are, of course, desireable. In particular, improved coatings having improved corrosion, oxidation, and thermal fatigue resistance as well as improved ductility, reduced spallation, and increased wettability woiuld be desirable and useful.

It is, therefore, an object of this invention to provide a metal coating composition as well as a coated article which are devoid of the above-noted disadvantages.

It is another object of this invention to produce coating compositions for use in hot, corrosive, combustion atmospheres of the type found in gas turbines.

It is still another object of the present invention to provide coating compositions which may be applied to nickel base, cobalt base or nickel-cobalt base superalloys, and which are highly resistant to hot corrosive attack and possess a very high degree of ductility.

It is yet another object of this invention to provide high temperature metal coating compositions wherein there is increased wettability or bonding between the modified matrix phase ($\gamma$) and the precipitate phase ($\beta$) of the two phase ($\gamma+\beta$) coating structure, resulting in reduced sites (microporosity) for thermal fatigue crack initiation and/or spallation and, hence superior performance.

It is a further object of this invention to provide coatings which have higher diffusion stability resulting in lower interaction with the superalloy substrate and, hence superior performance.

SUMMARY OF THE INVENTION

The foregoing objects, and others, are accomplished in accordance with this invention, generally speaking, by providing high temperature metal coating compositions, which may be applied to turbine engine components, which have one of the following formulas:

MCrAl+Rare Earth Metal (1)

MCRAl+Rare Earth Metal+Noble Metal (2)

MCrAl+Rare Earth Metal+Refractory Metal; or (3)

MCrAl+Rare Earth Metal+Rare Earth Metal+Noble Metal+Refractory Metal (4)

wherein M is a solid solution of molybdenum, tungstun or niobium in nickel, cobalt or nickel plus cobalt.

DETAILED DESCRIPTION OF THE INVENTION

The four coating compositions of the present invention contain small, but significant, amounts of molybdenum for improved wettability of the matrix solid solution (Ni, Co, Mo), also known as $\gamma$ phase, with the (Ni, Co, Al), also known as $\beta$ phase. Improved wettability or bonding reduces mircoporosity at the $\gamma$—$\beta$ interface which, in turn, improves thermal fatigue resistance and oxidation and corrosion resistance of the coatings. This is due to a reduced tendency to form cracks at the porosity locations. There is also a reduced tendency of spalling occuring and, in general, there is better performance. It was also surprising to discover that the presence of molybdenum reduces interaction of the coating with the superalloy substrate. This diffusional stability reduces the dilution of the coating composition due to interaction of the substrate and, in turn, enhances the performance.

Any suitable substrate may be used herein. Suitable substrate materials include superalloys such as nickel base and cobalt base superalloys, dispersion-strengthened alloys, composites, directionally solidified, single crystal and directional eutectics.

While molybdenum, tungsten or niobium may be used in this invention it is preferred to use molybdenum.

Suitable metal coating compositions which may be used in this invention comprise from about 30% to about 70% by weight nickel, cobalt, or nickel plus cobalt; from about 0.1% to about 12% by weight molybdenum; from about 10% to about 40% by weight chromium; from about 6% to about 20% by weight aluminum and about 0.01% to about 3.0% reactive metal.

While any reactive metal may be used in the present invention, very good results may be obtained with yttrium, scandium, thorium, lanthanum, other rare earth metals and mixtures thereof. Particularly good results are obtained with yttrium.

Other suitable metal coating compositions which may be used in this invention comprise from about 30% to about 70% by weight nickel, cobalt, or nickel plus cobalt; from about 0.1% to about 12% by weight molybdenum; from about 10% to about 40% by weight chromium; from about 6% to about 20% by weight aluminum and about 0.01% to about 3% reactive metal plus about 0.1% to about 10% by weight of a noble metal. Particularly good results are obtained when the noble metal, platinum, is used.

Still other suitable metal coating compositions which are suitable comprise from about 30% to about 70% by weight nickel, cobalt, or nickel plus cobalt; from about 0.1% to about 18% by weight molybdenum; from about 10% to about 40% by weight chromium; from about 6% to about 20% by weight aluminum and about 0.01% to about 3% reactive metal plus about 0.1% to about 10% by weight of a noble metal plus about 0.1% to about 8% by weight of a refractory metal. Particularly good results are obtained with the refractory metals hafnium and tantalum.

Preferred metal coating compositions of the present invention include:

1.

About 10%–40% by weight chromium;
About 0.5%–9% by weight molybdenum;
About 10%–35% by weight cobalt;
About 5%–20% by weight aluminum;
About 0.1%–1.0% by weight yttrium; and
The balance nickel, with the nickel, or nickel plus cobalt content in percent by weight being equal or greater than $$\frac{\text{\% by weight molybdenum}}{0.18}$$

2

About 10%–30% by weight chromium;
About 0.5%–9% by weight molybdenum;
About 10%–30% by weight cobalt;
About 5%–15% by weight aluminum;
About 0.1%–1.0% by weight yttrium;
About 2.0%–10% by weight platinum; and
The balance nickel, with the nickel, or nickel plus cobalt content in percent by weight being equal or greater than $$\frac{\text{\% by weight molybdenum}}{0.18}$$

3.

About 10%–40% by weight chromium;
About 0.5%–9% by weight molybdenum;

About 10%–35% by weight cobalt;
About 6%–20% by weight aluminum;
About 0.1%–1.0% by weight yttrium;
About 0.5%–8% by weight hafnium or hafnium plus tantalum; and
The balance nickel, with the nickel, or nickel plus cobalt content in percent by weight being equal or greater than $$\frac{\text{\% by weight molybdenum}}{0.18}$$

4

About 10%–40% by weight chromium;
About 0.5%–9% by weight molybdenum;
About 10%–35% by weight cobalt;
About 6%–20% by weight aluminum;
About 0.1%–1.0% by weight yttrium;
About 0.5%–8% by weight hafnium or hafnium plus tantalum;
About 2%–10% by weight platinum; and
The balance nickel, with the nickel, or nickel plus cobalt content in percent by weight being equal or greater than $$\frac{\text{\% by weight molybdenum}}{0.18}$$

Optimum results, wherein markedly improved thermal fatigue and oxidation and corrosion resistance are achieved with the following coating compositions:

1.

About 1%–6% by weight molybdenum;
About 10%–25% by weight cobalt;
About 15%–23% by weight chromium;
About 10%–14% by weight aluminum;
About 0.1%–1.0% by weight yttrium; and
The balance nickel, with the nickel, or nickel plus cobalt content in percent by weight being equal or greater than $$\frac{\text{\% by weight molybdenum}}{0.18}$$

2.

About 1%–6% by weight molybdenum;
About 10%–25% by weight cobalt;
About 15%–23% by weight chromium;
About 10%–14% by weight aluminum;
About 0.1%–1.0% by weight yttrium;
About 2%–6% by weight platinum; and
The balance nickel, with the nickel, or nickel plus cobalt content in percent by weight being equal or greater than $$\frac{\text{\% by weight molybdenum}}{0.18}$$

3.

About 1%–6% by weight molybdenum;
About 10%–25% by weight cobalt;
About 15%–23% by weight chromium;
About 10%–14% by weight aluminum;
About 0.1%–1.0% by weight yttrium;
About 0.5%–3% by weight hafnium;
About 2%–5% by weight tantalum; and
The balance nickel, with the nickel, or nickel plus cobalt content in percent by weight being equal or greater than $$\frac{\text{\% by weight molybdenum}}{0.18}$$

4.

About 1%–6% by weight molybdenum;
About 10%–25% by weight cobalt;
About 15%–23% by weight chromium;
About 10%–14% by weight aluminum;
About 0.1%–1.0% by weight yttrium;
About 0.5%–3% by weight hafnium;
About 2%–5% by weight tantalum;
About 2%–10% by weight platinum; and
The balance nickel, with the nickel, or nickel plus cobalt content in percent by weight being equal or greater than $$\frac{\text{\% by weight molybdenum}}{0.18}$$

The metal alloy composition may be applied to the substrate, such as a superalloy substrate, by several conventional methods such as vacuum vapor desposition, vacuum plasma spraying, sputtering, electron beam spraying, etc. It is preferable, herein, that the coatings be applied by means of a vacuum plasma spraying operation.

In vacuum plasma spraying, controlled amounts of the coating powder alloy are introduced in the plasma stream of the spray gun. The powder becomes molten and is projected at a very high velocity on the preheated (in the order of about 1,750° F.) surface of the part to be coated which is contained within a vacuum chamber under pressure of about $10^{-4}$ Torr or greater. Prior to coating, the surfaces to be coated are first thoroughly cleaned and then conditioned by abrasive blasting. This technique is described in U.S. Pat. No. 3,928,026. Upon impact against the surface to be coated, the coating alloy particles transfer thermal and mechanical energy to the substrate, producing forces which favor fusing and bonding, thus producing a dense and adherent coating. The plasma spraying technique is applicable to all of the compositions cited herein. Deposition time is controlled to obtain a coating thickness of between about 0.003 to about 0.005 inches. The coated article is cooled below 1,000° F. in a neutral atmosphere. The coated parts are then diffusion heat-treated at about 1,975° F. ±25° F. for about 4 hours in a vacuum or argon atmosphere to increase the bonding between the coating and the article to be coated.

The following experimental data will further demonstrate some of the advantages of the present invention.

A total of 5 coatings were prepared as follows (all percentages by weight):

Coating A (Prepared by sputter process)

23% Cobalt
18% Chromium
12% Aluminum
0.6% Yttrium
Remainder Nickel

Coating B (Prepared by plasma spray process)

23% Cobalt
18% Chromium
12% Aluminum
0.6% Yttrium
Remainder Nickel

Coating C (Prepared by plasma spray process)

1.2% Molybdenum
12% Cobalt
18% Chromium
12% Aluminum
0.6% Yttrium
Remainder Nickel Coating D (Prepared by pack aluminide process)

67% (55 Cr—45 Al alloy powder)+33% $Al_2O_3$

Coating E (Prepared by plasma spray process)

2.8% Molybdenum
12% Cobalt
18% Chromium
12% Aluminum
0.6% Yttrium
Remainder Nickel The plasma spraying is conducted in a low pressure chamber to develop a thickness between 76 μm–127 μm and an acceptable density of 98%. Specimens are glass bead peened at 6–7N intensity and diffusion heat treated at 1,065° C. for about 4 hours.

The aluminide coating is accomplished in a vacuum furnace with the pack held at 1,038° C. for about 4 hours, sufficient to give a coating thickness of between about 75 μm–100 μm.

Sputtering is a coating process wherein the particles, liberated from the target (M3958) surface by bombardment of energetic ions, are accelerated towards the substrate (superalloy) under the influence of an applied high voltage in a gas at $10^{-1}$ Torr or less to deposit the required coating.

Burner-rig facilities were utilized to perform the thermal fatigue and oxidation/corrosion testing. The thermal fatigue was conducted on a gas fired rig which is a self-contained unit consisting of gas, combustion air, pneumatic and water quench control systems. The gas and combustion air systems are controlled through an electrical system which includes safety circuits for proper ignition of the gas burners. The burners are capable of providing 73.2 KW of heat at maximum setting. The control system utilizes timers which control the initiation and duration of the heating and cooling cycles as well as the air and water solenoid valves. The heating and cooling cycles can be preset over a wide range. The specimen holder is a water cooled specimen shaft and is mounted on bearings which permits movement of the specimen shaft assembly into and out of the furnace. A couple mounted on the outside of the shaft rotates the specimens to a speed of 1,750 rpm. A radiation pyrometer is used to sense and control the metal temperature. When the heating cycle is completed, the specimens are retracted into a cooling chamber, where the cooling water jet is activated. The cycle automatically restarts at the end of the cooling cycle.

Thermal Fatigue Tests

All coating systems were screened for thermal fatigue cracking performance using a time cycle of 4 minutes. The test cycle consisted of holding the specimens at 1,038° C. for 2 minutes followed by mist cooling.

Results were obtained as demonstrated in Table #1.

TABLE #1

| Coating | Cycles to Crack Initiation | Average Length of 3 Largest Cracks at 2,500 Cycles | Total No. Of Cracks |
|---|---|---|---|
| A | 807 | 0.116" | 40 |
| B | 1,497 | 0.132" | 30 |
| C | 1,572 | 0.064" | 30 |
| D | 1,062 | 0.27" | 13 |

A second test was performed under the same experimental conditions using a higher mist cooling rate. Results were obtained as demonstrated in Table #2.

TABLE #2

| Coating | Cycles to Crack Initiation | Average Length of 3 Largest Cracks at 1,615 Cycles | Total No. Of Cracks |
|---|---|---|---|
| B | 892 | 0.237" | 19 |
| C | 1,104 | 0.155" | 10 |
| E | 1,232 | 0.156" | 9 |

Oxidation/Corrosion Resistance Test

A fuel fired rig facility was used for oxidation/corrosion testing. This rig is a self-contained facility with its own air compressor, air preheater, test chamber and fuel system. High velocity gases of approximately 215 m/s are impinged against the airfoil test specimens to raise them to the desired temperature. A converging nozzle is used to direct and concentrate the flame on the specimens. Synthetic sea water is injected into the gas stream just below the skirt of the combination liner. The combuster burned JP-5+0.2% S fuel for this test. The pressure in the test chamber is essentially atmospheric. The air to fuel ratio ranges from about 28:1–33:1 depending on the test temperature. Air flow is maintained constant at 0.0378 kg/sec. at 285° C. while the fuel flow is controlled by means of a pyrometer which senses the metal temperatures. The specimen is rotated in order to expose all specimens uniformly. Heating and cooling cycles are accomplished by alternately translating the specimen holder between the furnace heating and cooling chambers. Thermal cooling can be imposed by air, water mist and/or water jet.

The oxidation/corrosion tests undertaken were conducted on coating A, C and E, described above. A two temperature-set point, 6.75 minute cycle (1,650° F./2 minutes and 1,950° F./2 minutes and water cool) was used for testing. The salt/air ratio was maintained at 6 ppm and 0.2% sulfur was added to the JP-5 fuel. Three specimens (A,C and E) were placed in the specimen holder and the test specimens were weighed and visually inspected at 20 hour intervals. The comparative weight loss of various coatings at the end of a 200 hour cyclic oxidation/corrosion test is listed in Table 3, below.

TABLE #3

| Coating | Δ % — weight loss |
|---|---|
| A | 0.45 |
| C | 0.3 |
| E | 0.55 |

While specific components of the present system are defined above, many other variables may be introduced which may in any way affect, enhance or otherwise improve the coating systems of the present invention.

While variations are given in the present application, many modifications and ramifications will occur to those skilled in the art upon reading the present disclosure. These are intended to be included herein.

What is claimed is:

1. An article of manufacture comprised of a superalloy substrate coated with a high temperature coating composition consisting essentially of from about 10% to about 40%, by weight, chromium; from about 0.5% to about 9% by weight, molybdenum; from about 10% to about 35%, by weight, cobalt; from about 5% to about 20%, by weight, aluminum; from about 0.1% to about 1% by weight, yttrium; and the balance nickel, the nickel or nickel plus cobalt content, in percent by weight, being equal to or greater than percent by weight molybdenum divided by 0.18.

2. An article of manufacture comprised of a superalloy substrate coated with a high temperature coating composition consisting essentially of from about 10% to about 40%, by weight, chromium; from about 0.5% to about 9%, by weight, molybdenum; from about 10% to about 30%, by weight, cobalt; from about 5% to about 15%, by weight, aluminum; from about 0.1% to about 1%, by weight, yttrium; from about 2% to about 10%, by weight, platinum; and the balance nickel, the nickel or nickel plus cobalt content, in percent by weight, being equal to or greater than percent by weight molybdenum divided by 0.18.

3. An article of manufacture comprised of a superalloy substrate coated with a high temperature coating composition consisting essentially of from about 10% to about 40%, by weight, chromium; from about 0.5% to about 9%, by weight, molybdenum; from about 10% to about 35%, by weight, cobalt; from about 6% to about 20%, by weight, aluminum; from about 0.5% to about 8%, by weight, hafnium; from about 0.1% to about 1%, by weight, yttrium; and from about 2% to about 10%, by weight, platinum; the balance nickel, the nickel or nickel plus cobalt content in percent by weight, being equal to or greater than percent by weight molybdenum divided by 0.18.

4. An article of manufacture comprised of a superalloy substrate coated with a high temperature coating composition consisting essentially of from about 15% to about 23%, by weight, chromium; from about 1% to about 6%, by weight, molybdenum; from about 10% to about 25%, by weight, cobalt; from about 10% to about 14%, by weight, aluminum; from about 0.1% to about 1%, by weight, yttrium; and the balance nickel or nickel plus cobalt content in percent by weight, being equal to or greater than percent by weight molybdenum divided by 0.18.

5. The article of manufacture of claim 4 wherein the coating composition contains from about 2% to about 6%, by weight, platinum.

6. An article of manufacture comprising a substrate material coated with a coating composition having the general formula MCrAl+Rare Earth Metal wherein M is a solid solution of a first metal selected from the group consisting of molybdenum and niobium and a second metal selected from the group consisting of nickel, cobalt and mixtures thereof, the composition consisting essentialy of from about 0.1 to about 12% by weight of the first metal and from about 30% to about 70% by weight of the second metal; about 10% to about 40% by weight chromium; from about 6% to about 20% by weight aluminum and about 0.01% to about 3% by weight of the rare earth metal.

7. The article of manufacture of claim 6 wherein the coating composition contains about 0.1 to about 10% by weight of a noble metal.

8. The article of manufacture of claim 7 wherein the noble metal is platinum.

9. The article of manufacture of claim 6 wherein the coating composition contains from about 0.1% to about 8% by weight of a refractory metal.

10. The article of manufacture of claim 6, 7, 8 or 9 wherein the rare earth metal is selected from the group consisting of yttrium, scandium, thorium, lanthanum and mixtures thereof.

11. The article of manufacture of claim 6 wherein the rare earth metal is yttrium.

12. The article of manufacture of claim 9 wherein the refractory metal is selected from the group consisting of hafnium and tantalum.

13. The article of manufacture of claim 6 wherein the substrate material is comprised of a nickel base or cobalt base superalloy.

14. A process for coating superalloy substrates which comprises:

(1) introducing in the plasma stream of a spray gun, controlled amounts of a powdered composition having the general formula MCrAl+Rare Earth Metal wherein M is a solid solution of a first metal selected from the group consisting of molybdenum and niobium and a second metal selected from the group consisting of nickel, cobalt and mixtures thereof, the composition consisting essentially of from about 0.1 to about 12% by weight of the first metal and from about 30% to about 70% by weight of the second metal; and about 10% to about 40% by weight chromium; from about 6% to about 20% by weight aluminum and about 0.01% to about 3% by weight of the rare earth metal;

(2) projecting the powdered composition in molten form at high velocity onto a preheated surface of the superalloy under a vacuum of at least about $10^{-4}$ torr and then (3) cooling the coated superalloy to below 1000° F. in a neutral atmosphere.

15. A high temperature coating having the general formula MCrAl+Rare Earth Metal wherein M is a solid solution of a first metal selected from the group consisting of molybdenum and niobium and a second metal selected from the group consisting of nickel, cobalt and mixtures thereof, the composition consisting essentially of from about 0.1 to about 12% by weight of the first metal and from about 30% to about 70% by weight of the second metal; about 10% to about 40% by weight chromium; from about 6% to about 20% by weight aluminum and about 0.01% to about 3% by weight of the rare earth metal.

16. The coating composition of claim 15 containing about 0.1 to about 10% by weight of a noble metal.

17. The coating composition of claim 16 containing the noble metal platinum.

18. The coating composition of claim 15 containing from about 0.1% to about 8% by weight of a refractory metal.

19. The coating composition of claim 15, 16, 17 or 18 wherein the rare earth metal is selected from the group consisting of yttrium, scandium, thorium, lanthanum and mixtures thereof.

20. The coating composition of claim 15 wherein the rare earth metal is yttrium.

21. The coating composition of claim 18 wherein the refractory metal is selected from the group consisting of hafnium and tantalum.

22. A high temperature coating composition consisting essentially of from about 10% to about 40%, by weight, chromium; from about 0.5% to about 9% by weight, molybdenum; from about 10% to about 35%, by weight, cobalt; from about 5% to about 20%, by weight, aluminum; from about 0.1% to about 1% by weight, yttrium; and the balance nickel, the nickel or nickel plus cobalt content, in percent by weight, being equal to or greater than percent by weight molybdenum divided by 0.18.

23. A high temperature coating composition consisting essentially of from about 10% to about 40%, by weight, chromium; from about 0.5% to about 9%, by weight, molybdenum; from about 10% to about 30%, by weight, cobalt; from about 5% to about 15%, by weight, aluminum; from about 0.1% to about 1%, by weight, yttrium; from about 2% to about 10%, by weight, platinum; and the balance nickel, the nickel or nickel plus cobalt content, in percent by weight, being equal to or greater than percent by weight molybdenum divided by 0.18.

24. A high temperature coating composition consisting essentially of from about 10% to about 40%, by weight, chromium; from about 0.5% to about 9%, by weight, molybdenum; from about 10% to about 35%, by weight, cobalt; from about 6% to about 20%, by weight, aluminum; from about 0.5% to about 8%, by weight, hafnium; from about 0.1% to about 1%, by weight, yttrium; and from about 2% to about 10%, by weight, platinum; the balance nickel, the nickel or nickel plus cobalt content in percent by weight, being equal to or greater than percent by weight molybdenum divided by 0.18.

25. A high temperature coating composition consisting essentially of from about 15% to about 23%, by weight, chromium; from about 1% to about 6%, by weight, molybdenum; from about 10% to about 25%, by weight, cobalt; from about 10% to about 14%, by weight, aluminum; from about 0.1% to about 1%, by weight, yttrium; and the balance nickel or nickel plus cobalt content in percent by weight, being equal to or greater than percent by weight molybdenum divided by 0.18.

26. The coating composition of claim 25 containing from about 2% to about 6%, by weight, platinum.

* * * * *

UNITED STATES PATENT AND TRADEMARK OFFICE

CERTIFICATE OF CORRECTION

PATENT NO. : 4,451,431

DATED : May 29, 1984

INVENTOR(S) : Subhash K. Naik

It is certified that error appears in the above-identified patent and that said Letters Patent are hereby corrected as shown below:

Column 3, line 33 should read:

"(4) MCrAl + Rare Earth Metal + Noble Metal + Refractory Metal"

Signed and Sealed this

*Thirteenth* Day of *November 1984*

[SEAL]

*Attest:*

GERALD J. MOSSINGHOFF

*Attesting Officer*

*Commissioner of Patents and Trademarks*